United States Patent [19]

Held et al.

[11] 4,253,030

[45] Feb. 24, 1981

[54] PROCESS FOR THE ULTIMATE DISPOSAL OF SPENT FUEL ELEMENTS AND HIGHLY ACTIVE WASTE FROM NUCLEAR POWER PLANTS

[75] Inventors: Christian Held, Vienna; Norbert Krimm, St. Pölten; Günter Moraw, Vienna; Michael Schneeberger, Klosterneuburg; Andreas Szeless, Vienna, all of Austria

[73] Assignee: Kernkraftwerk Planungsgesellschaft m.b.H., Vienna, Austria

[21] Appl. No.: 936,083

[22] Filed: Aug. 23, 1978

[30] Foreign Application Priority Data

Aug. 26, 1977 [AT] Austria ..... 6187/77

[51] Int. Cl.[2] ..... G21F 5/00

[52] U.S. Cl. ..... 250/506; 250/507

[58] Field of Search ..... 250/506, 507, 515, 518, 250/451, 456; 176/DIG. 2, 67, 87

[56] References Cited

U.S. PATENT DOCUMENTS

| | | | |
|---|---|---|---|
| 3,934,152 | 1/1976 | Alleaume | 250/506 |
| 4,040,480 | 8/1977 | Richards | 250/506 |

OTHER PUBLICATIONS

"Secure Storage of Radioactive Waste", Dan et al., EPRI Jour., No. 6, Jul./Aug. 1976, pp. 6–14.

*Primary Examiner*—Bruce C. Anderson

*Attorney, Agent, or Firm*—Blanchard, Flynn, Thiel, Boutell & Tanis

[57] ABSTRACT

A process for the final disposal of spent fuel elements and highly active waste from nuclear power plants inserted in receptacles wherein the receptacles are inserted into a groove provided in the bottom of an approximately horizontally extending tunnel.

6 Claims, 2 Drawing Figures

PROCESS FOR THE ULTIMATE DISPOSAL OF SPENT FUEL ELEMENTS AND HIGHLY ACTIVE WASTE FROM NUCLEAR POWER PLANTS

FIELD OF THE INVENTION

The invention relates to a process for the ultimate disposal of spent fuel elements and highly active waste from nuclear power plants that have been placed in receptacles.

BACKGROUND OF THE INVENTION

The final disposal of spent fuel elements and highly active waste must safeguard that no radioactive constituents can enter the biosphere over a period of geological dimensions.

In nuclear power plants it is necessary to replace the fuel elements after certain intervals irrespectively of the type in use at the present time. In the case of ordinary water reactors, for example, approximately 25 t of spent fuel elements are obtained for every 1,000 MW of power output in the course of a year. These contain around 96% isotopes of uranium and transuranics and around 4% nuclides resulting from the nuclear fission process of the chain reactions.

Spent fuel elements can be stored in the nuclear power plant itself for a period of some years. However, once the storage capacity of the plant ceases to be adequate they are transferred to external storage sites in accordance with the present state of the art. Here they are guarded to provide protection against radiation and are cooled. These storage sites are engineering structures of varying kind which need to be secure against external influences. However, since they would require long-term surveillance, they cannot be regarded as the ultimate disposal site.

The valuable portion of the uranium and plutonium can be recovered in treatment plants and recycled to the fuel circulation. The remaining active fission products are nuclides of medium atomic weight which cannot be utilized at the present time. They are mainly metals which are obtained in the form of salts. For their final disposal they are converted into an insoluble and not leachable form. In accordance with the present state of the art, this consists in vitrifying them or sintering them to form part of a metal lattice and then pouring into a tank made of chromium-nickel steel. These tanks, after the fission products have been diluted in glass or a metallurgical matrix, display a more or less strong evolution of heat due to radioactive decay and also gamma and neutron radiation. Such vitrified or sintered residues represent high-level radioactive waste from nuclear technology sources.

Treatment plants for oxidic fuel from ordinary water reactors of small capacity have already been constructed. The waste vitrified there is being stored provisionally at the present time. Experimental burial in geological formations is being considered.

Since spent fuel elements are going to arise in increasing amounts over the coming years, there is a worldwide effort to develop methods for the geological final disposal of spent fuel elements and other, more especially highly active waste.

A geological ultimate disposal must fulfill the following requirements: (a) Burial must ensue in geologically old formations which, as far as can be foreseen, are not exposed to tectonic or other changes; (b) These geological formations shall display no clefts, faults, veins or inclusions, i.e. shall be formations without water-bearing strata or veins; (c) The opening up process, more especially in the area envisaged for the burial, must be performed so as to conserve the rock formation; (d) No impermissible amounts of radioactive components must be able to enter the biosphere from the ultimate burial site as a result of dissolution, leaching, radiolytic decomposition or other processes; (e) Introducing the receptacles with radioactive waste into the ultimate disposal site must endanger neither the personnel nor the environment; (f) The heat must be dissipated in such a way as not to cause a change in structure of the surrounding rocks or a harmful warming up of the surrounding biosphere; (g) Except for relative short-term sample deposits, the spent fuel elements or the buried highly active waste shall remain capable of being retrieved under certain conditions for some time; (h) The ultimate disposal site shall be capable of being sealed in the foreseeable future, i.e. in about 30 to 50 years, so that no further maintenance or surveillance is necessary; the hollow spaces (caves) are then to be filled with material of a type as similar as possible, thus avoiding fractures in the mine structure.

To meet these requirements either salt domes with a cover of dense clay layers or crystalline rocks such as granite and gneiss are being considered as the ultimate disposal site at the present time. However, other formations too are feasible. The fuel elements or the highly active waste are introduced either while provided with a protective screen serving during the transportation, with the rock performing the long-term screening. Alternatively, they are provided with a lost screen, which needs to be thermally conducting. To this end they are poured into lead or introduced into a sealed steel cylinder of adequate thickness. Such steel cylinders will be referred to as receptacles in the following.

With the exception of a process in which the receptacles are set up to be freely exposed and the heat is carried away by air, i.e. by ventilation, all processes which have been disclosed hitherto are based on the provision of boreholes of varying arrangements emanating from a tunnel system for accomodating the receptacles. However, such a process suffers from the drawback that, after excavating the tunnel, the drilling device for making the holes needs to be moved from one borehole to the next. As a consequence the making of the holes is made more difficult and, hence, more expensive. Furthermore, any receptacles which have been introduced into boreholes can be removed from these only with some difficulty.

Accordingly, the invention serves the aim of creating a process in accordance with which the receptacles are deposited in economic manner and, moreover, can be removed again in simple manner. In accordance with the invention this is achieved by providing a groove in the floor of an approximately horizontally extending tunnel. The receptacles are inserted in this groove. Preferably, the space remaining between the groove and the receptacles is filled in. The groove can be fashioned by widening the tunnel along its bottom by a groove or by providing the bottom of the tunnel with a layer of concrete in which a groove is hollowed out. The space between the groove and the receptacles may be filled in with a material which fulfills protective functions such as the absorption of radiation, the exchange of ions and the barring of the entry of moisture. Bitumen can form at least a part of the filling-in material.

After the receptacles have been inserted in the groove and the filling-in operation has been carried out, the groove can be covered with plates capable of being walked or driven over, i.e. substantially rigid plater, and, preferably, having an anti-radiation effect. Ultimately, after filling, the tunnel can be filled in completely.

BRIEF DESCRIPTION OF THE DRAWINGS

The invention is described in greater detail by reference to the drawing which, in FIGS. 1 and 2, shows cross-sections through two tunnels.

DETAILED DESCRIPTION

Figure 1:
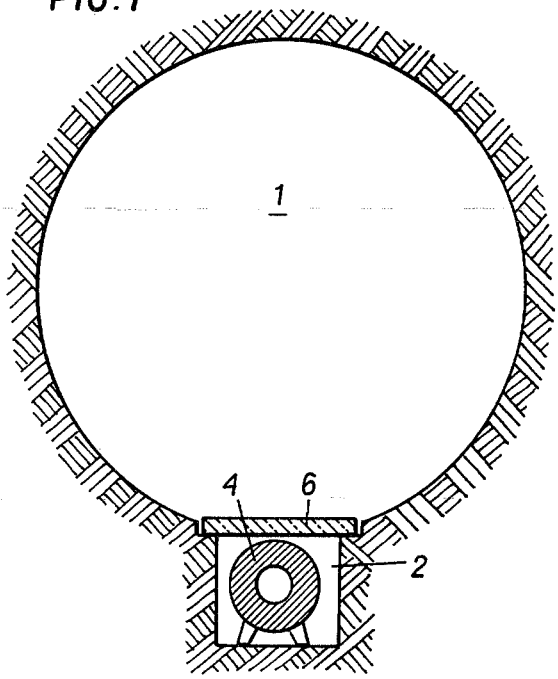
Figure 2:
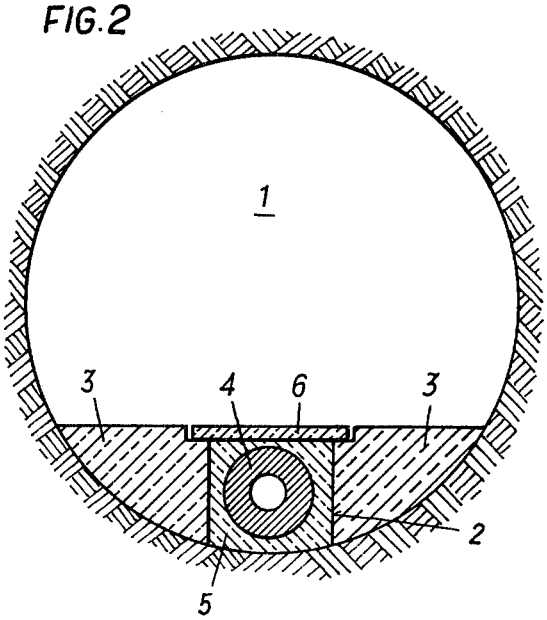

In accordance with the invention, a tunnel 1 of desired length is produced by means of a tunnel driving machine in a manner which conserves the rock structure. Such machines are being used at the present time for tunnel diameters of from 3 to 4 meters mainly for water-bearing tunnels. A groove 2 is provided in the bottom of the tunnel 1 to be a little wider than the diameter of the receptacles. As is shown in FIG. 1, the groove 2 may be cut in the rock in the bottom of the tunnel 1. For this purpose a machine similar to the drilling machine can be used (see FIG. 1). Alternatively, the groove 2 can be produced by providing a layer of concrete 3 along the bottom of the tunnel. A groove 2 is left in being in this layer (see FIG. 2). By means of suitable conveying means, for example a charging machine or an overhead crane, receptacles 4 are inserted. These may be arranged to be closed together or, if the requirement of heat dissipation does not allow it, spaced away from each other.

To prevent the bulk of the heat from the inserted receptacles 4 from being dissipated via the air, i.e. via the ventilation provided, the groove 2 around the receptacles 4 may be filled with a suitable material 5, for example concrete. In this way the heat is led away into the rock in at least three directions and merely the air above the groove 2 is heated up somewhat. A material with additional protective properties such as protection against radiation, the capacity for ion exchange or moisture barrier properties, for instance bitumen or rolled asphalt, can be selected to serve as the filling 5. The base layer of the filling may be introduced before the receptacles 4 are inserted.

The groove 2 may be covered with plates 6. The tunnel can then be walked upon or driven upon and observations can be carried out over extended periods of time. Also, individual receptacles 4 can be retrieved after removing the filling 5.

After a tunnel has been fully occupied and all measurements and observations have taken a satisfactory course, the tunnel can be filled in completely, preferably with material similar in type to the material of the rock, for example pumped concrete containing material from the workings as aggregate. Subsequently it is sealed with a wall.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a process for fixed disposition of highly radioactive waste, such as spent fuel elements from nuclear power plants, wherein such waste is contained in receptacles and such waste-containing receptacles are stored in underground tunnels, the improvement comprising:

causing the tunnel to extend substantially horizontally;

providing a shallow groove in and extending along the surface of the tunnel with the depth and width of said groove being sufficient to receive the diameter of a receptacle therein;

laying a series of said receptacles in said groove at a desired spacing from one to the next along said groove, said groove extending substantially in the length direction of said tunnel;

filling in the part of the space of the groove unoccupied by the receptacles therein with material which provides at least one of absorption of radiation, ion exchange and a moisture barrier effect, and covering the thus-filled, receptacles-containing groove with plates each spanning the width of the groove and sufficiently rigid to provide a walk or driveway along the floor of the tunnel, said plates being of conventional material providing at least some radiation protection effect.

2. The improved process as claimed in claim 1 in which the said groove and said receptacles therein extend lengthwise of said tunnel, and the series of receptacles in said groove extends substantially parallel to the surface of the tunnel floor.

3. The improved process as claimed in claim 1, in which the step of providing said groove includes enlarging the cross section of the tunnel by cutting said groove along the tunnel floor.

4. The improved process as claimed in claim 1, wherein the step of providing said groove includes placing a layer of concrete along the floor of said tunnel with said groove formed as a hollow in and extending along said layer of concrete.

5. The improved process as claimed in claim 1, wherein the filling-in material consists at least in part of bitumen.

6. The improved process as claimed in claim 1, including filling in the tunnel completely after it has been fully occupied.

* * * * *